United States Patent [19]

Blight et al.

[11] 4,252,469

[45] Feb. 24, 1981

[54] METHOD AND APPARATUS FOR INSTALLING INTEGRATED DECK STRUCTURE AND RAPIDLY SEPARATING SAME FROM SUPPORTING BARGE MEANS

[75] Inventors: Graham J. Blight; Heinz K. Rohde; Phillip A. Abbott, all of Houston, Tex.

[73] Assignee: Brown & Root, Inc., Houston, Tex.

[21] Appl. No.: 24,681

[22] Filed: Mar. 28, 1979

[30] Foreign Application Priority Data

Apr. 3, 1978 [GB] United Kingdom ..... 13000/78

[51] Int. Cl.[3] ..... E02D 25/00

[52] U.S. Cl. ..... 405/204; 114/264; 405/203; 405/209

[58] Field of Search ..... 405/195–209, 405/188–191, 194; 114/264–267; 254/105–112

[56] References Cited

U.S. PATENT DOCUMENTS

| | | | |
|---|---|---|---|
| 36,606 | 10/1862 | Bois . | |
| 1,259,762 | 3/1918 | McPartland | 405/194 |
| 1,643,733 | 9/1927 | Wood | 405/188 X |
| 2,210,408 | 8/1940 | Henry | 405/196 |
| 2,475,933 | 7/1949 | Woolslayer et al. | 405/209 |
| 2,598,329 | 5/1952 | Wilson | 405/204 |
| 2,771,747 | 11/1956 | Rechtin | 405/204 |
| 2,817,212 | 12/1957 | Stubbs | 405/209 |
| 2,881,590 | 4/1959 | Zaskey | 405/209 |
| 2,907,172 | 10/1959 | Crake | 405/209 |
| 2,940,266 | 6/1960 | Smith | 405/204 |
| 2,979,910 | 4/1961 | Crake | 405/208 |
| 3,011,318 | 12/1961 | Ashton | 405/209 |
| 3,078,680 | 2/1963 | Wepsala | 405/209 |
| 3,857,247 | 12/1974 | Phares | 405/227 |
| 3,876,181 | 4/1975 | Lucas | 405/198 |
| 3,977,346 | 8/1976 | Natrig et al. | 114/264 X |
| 4,002,038 | 1/1977 | Phares et al. | 405/199 |
| 4,012,917 | 3/1977 | Gendron | 405/224 |
| 4,090,367 | 5/1978 | Verschure | 405/195 |

FOREIGN PATENT DOCUMENTS

| | | |
|---|---|---|
| 6713706 | 4/1969 | Netherlands . |
| 1190697 | 5/1970 | United Kingdom . |
| 1220689 | 1/1971 | United Kingdom . |
| 1380586 | 1/1975 | United Kingdom . |
| 1382118 | 1/1975 | United Kingdom . |
| 1419266 | 12/1975 | United Kingdom . |
| 1430084 | 3/1976 | United Kingdom . |
| 1466279 | 3/1977 | United Kingdom . |
| 1469490 | 4/1977 | United Kingdom . |

*Primary Examiner*—Dennis L. Taylor
*Attorney, Agent, or Firm*—Kenway & Jenney

[57] ABSTRACT

Methods and apparatus for offshore operations including individually significant aspects comprising:

1. Methods and apparatus for providing lateral force transmitting arch means extending across a vessel passageway which is laterally bounded by upwardly projecting portions of a substructure and bounded on the top by an integrated deck:
2. Methods and apparatus for assembling an integrated deck with a substructure wherein there are effected horizontal and vertical shock absorbing action, motion dampening, and desired alignment; and
3. Methods and apparatus for assemblying an integrated deck with a substructure wherein, at a relatively slower rate, an integrated deck is lowered into engagement with a substructure and, at a subsequent more rapid rate, a vessel initially supporting the integrated deck is vertically separated therefrom.

3 Claims, 29 Drawing Figures

METHOD AND APPARATUS FOR INSTALLING INTEGRATED DECK STRUCTURE AND RAPIDLY SEPARATING SAME FROM SUPPORTING BARGE MEANS

GENERAL BACKGROUND AND SUMMARY

For the past several decades, practioners in the offshore art have endeavored to develop commercially acceptable techniques for the fabrication of offshore structures, utilizing what is termed an "integrated deck".

An integrated deck comprises a pre-assembled deck structure which is operable to be installed in one piece on a substructure, such as a steel "jacket" or a concrete gravity base.

A steel "jacket" comprises a framework which is anchored to a submerged surface, conventionally by piling which may pass through the jacket legs or other cylinders carried by the jacket. A gravity base platform may or may not be pile-connected to a submerged surface but is sufficiently heavy such that its own weight or "gravity" provides a significant anchoring force.

In any event, the concept now under consideration pertains primarily to technique for installing an integrated deck on the top of a previously installed substructure.

Prior efforts in this art or in the bridge construction art, and pertaining to deck setting, are generally exemplified by the following disclosures:

| Patent/Country/Issue or Publication Date | Patentee | Subject Matter |
|---|---|---|
| 36,606/U.S./Oct. 7, 1862 | DuBois | Bridge arch set by barge |
| 2,210,408/U.S./Aug. 6, 1940 | Henry | Deck with diagonal under framing |
| 2,475,933/U.S./July 12, 1949 | Woolslayer et al | Skid-off deck installation |
| 2,771,747/U.S./Nov. 27, 1956 | Rechtin | Jack-up deck |
| 2,817,212/U.S./Dec. 24, 1957 | Stubbs | Tensioned cable with shock absorbers for supporting deck on barge |
| 2,881,590/U.S./Apr. 14, 1959 | Zaskey | Yieldable rockers supporting deck on barge |
| 2,907,172/U.S./Oct. 6, 1959 | Crake | Alignment cables between deck and substructure, with deck lowered on shock absorbing rams and fenders between deck supporting barge and substructure |
| 2,940,266/U.S./June 14, 1960 | Smith | Deck ballasted down to substructure |
| 2,979,910/U.S./Apr. 18, 1961 | Crake | Substructure maneuvered by vessel |
| 3,011,318/U.S./Dec. 5, 1961 | Ashton | Deck supporting barge rapidly ballasted down |
| 3,078,680/U.S./Feb. 26, 1963 | Wepsala | Deck lowering yoke on vessel |
| 3,857,247/U.S./Dec. 31, 1974 | Phares | Deck lifting rods on substructure |
| 3,876,181/U.S./Apr. 8, 1975 | Lucas | Deck elevating jack-up legs coact with substructure |
| 4,002,038/U.S./Jan. 11, 1977 | Phares | Deck set with derrick |
| 4,012,917/U.S./Mar. 22, 1977 | Gendron | Deck set with derrick |
| 1,190,697/U.K./May 6, 1970 | Global Marine | Mating sockets between lowered deck and substructure |
| 1,220,689/U.K./Jan. 27, 1971 | Netherlands Offshore Co. | Dual barges to lower deck to submerged substructure |
| 1,380,586/U.K./Jan. 15, 1975 | Redpath Dorman Long | Deck lifted on platform |
| 1,382,118/U.K./Jan. 29, 1975 | Redpath Dorman Long | Deck lifted on platform |
| 1,419,266/U.K./Dec. 24, 1975 | Redpath Dorman Long | Substructure maneuvered by vessel |
| 1,430,084/U.K./Mar. 31, 1976 | Redpath Dorman Long | Deck lowered onto submerged substructure |
| 1,466,279/U.K./Mar. 2, 1977 | A/S Akers Mek Verksted | Jacks or barge to lower deck |
| 1,469,490/U.K./Apr. 6, 1977 | Raymond Int. | Deck elevated on substructure |
| 6,713,706/Dutch/Apr. 11, 1969 | Netherlands Offshore Co. | Arch deck supported on two barges and lowered so as to overhang substruc- |

-continued

| Patent/Country/Issue or Publication Date | Patentee | Subject Matter |
|---|---|---|
| | | ture |

Whatever may be said with respect to the state of the art as exemplified by these prior art patent disclosures, the present invention is directed to significantly advancing the efficacy and reliability of methods and apparatus involved in the handling and installation of integrated deck structures.

One independently significant aspect of the invention relates to methods and apparatus which are designed to effect net reductions in the overall weight of integrated deck units and provide effective, lateral force transmission across a vessel passageway defined by the upper portion of a completed installation.

In a method sense, this first method aspect of the invention may be characterized as follows:

A method of erecting an offshore structure comprising:

transportable substructure means connected with a submerged surface and including a slotted upper end defining a vessel passage way;

said method being characterized by:

providing integrated deck means operable to be supported on vessel means for transportation to the vicinity of said substructure means, with said vessel means moving into said passage way so as to position said integrated deck means generally above said substructure means and in alignment therewith;

causing said vessel means to lower said integrated deck means onto the top of said substructure means and form said offshore structure; and providing in said offshore structure, comprising said interconnected substructure means and integrated deck means, with lateral force transmitting means carried by one of said substructure means and said integrated deck means, defining lateral force transmitting, arch-like means extending transversely from opposite sides of said vessel passageway, generally across at least side portions of said vessel passageway to an intermediate portion of one of said jacket means and integrated deck means, and at least partially extending across said vessel means while said integrated deck means is supported thereon and said vessel means is in said passageway said lateral force transmitting means extending laterally beyond side portions of said vessel means, with outer portions thereof being disengaged therefrom when said integrated deck means is supported thereon, and said vessel means is disposed in said passageway.

This first aspect of the invention also involves apparatus means for implementing the method steps which characterize the method aspect set forth above, as well as various refinements of the basic concept, as described in claims hereinafter set forth.

A second independently significant aspect of the invention relates to methods and apparatus which are designed to concurrently effect vertical and horizontal shock absorbing action, wave action induced motion dampening, and desired alignment, as an integrated deck is being installed on a substructure.

In a method sense, this second independently significant aspect of the invention may be defined as follows: A method of erecting an offshore structure comprising:

substructure means;

integrated deck means; and transfer means operable to effect engagement between said integrated deck means and said substructure means, and transfer said integrated deck means from a floating vessel means to said substructure means;

said method being characterized by the provision in said transfer means of:

yieldable means carried by at least one of said substructure means and said integrated deck means and operable to provide yieldable, horizontal shock absorbing action directly between said integrated deck means and said substructure means during their mutual engagement, provide yieldable, vertical shock absorbing action between said integrated deck means and said substructure means during their mutual engagement, provide motion dampening of said integrated deck means, and tend to effect a generally desired alignment between mutually engageable portions of said substructure means and said integrated deck means during transfer of said integrated deck means from said vessel means to said substructure means.

This second aspect of the invention also involves apparatus means for implementing the method steps which characterize the second method aspect set forth above and various refinements of the basic concept, as described in claims hereafter.

A third, independently significant method aspect of the invention involves a method for effecting the installation of an integrated deck on a substructure in two stages, with a second stage thereof involving materially more rapid lowering movement than the first stage for the purpose of effecting rapid separation of the integrated deck and a vessel which buoyantly supports the integrated deck.

In relation to method features of this third aspect of the invention, the following description is in order:

A method of forming an offshore structure comprising:

providing substructure means, connected with a submerged surface;

supporting an integrated deck means on vessel means;

moving said vessel means so as to position said integrated deck means over said substructure means;

lowering said integrated deck means at a first, relatively slower transfer rate so as to transfer the load of said integrated deck means from said vessel means to said substructure means; and thereafter separating previously engaged portions of said vessel means and said integrated deck means at a second, relatively more rapid rate, thereby reducing tendencies for wave action-induced forces and movements to cause damage to said integrated deck means and vessel means.

This third aspect of the invention also involves apparatus means for implementing the method steps which characterize the third method aspect set forth above and various refinements of the basic concept, as described in claims hereafter.

As will be recognized, a fourth independently significant aspect of the invention relates to various permutations and combinations of the method and apparatus aspects noted above, including the specific refinements and embellishments described and claimed thereinafter.

In describing the inventions, reference will be made to certain presently preferred embodiments, keeping in mind that such descriptions are intended to be by way of example but not by way of limitation with respect to the overall inventive concepts as herein presented.

In describing these preferred embodiments, reference will be made to the appended drawings.

DRAWINGS

As shown in the appended drawings:

FIG. 1 provides a schematic, side elevational view of a substructure which is resting on a submerged surface but displaced somewhat from a desired installation position;

Figure 5:
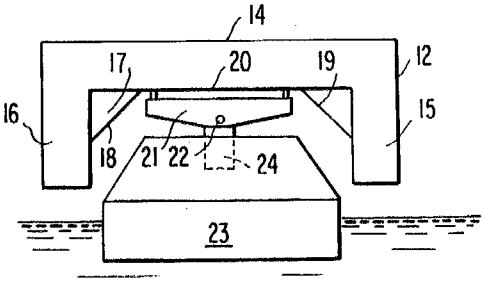
Figure 4:
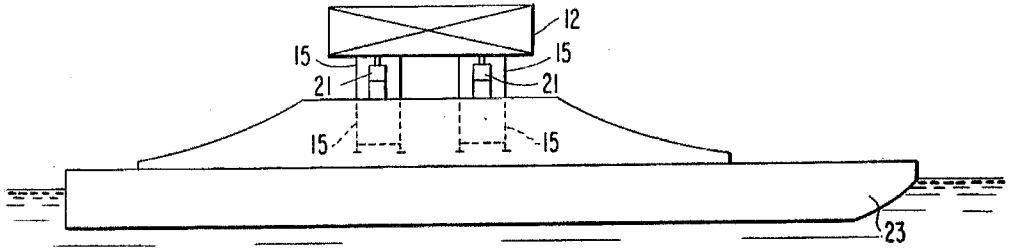
Figure 8:
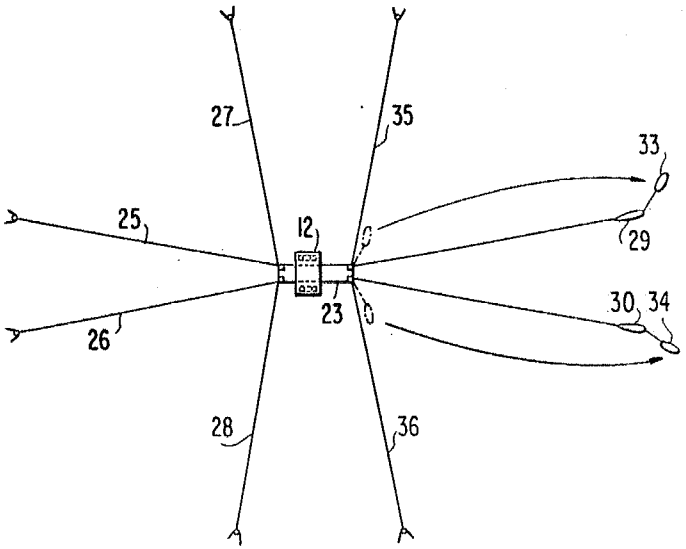
Figure 7:
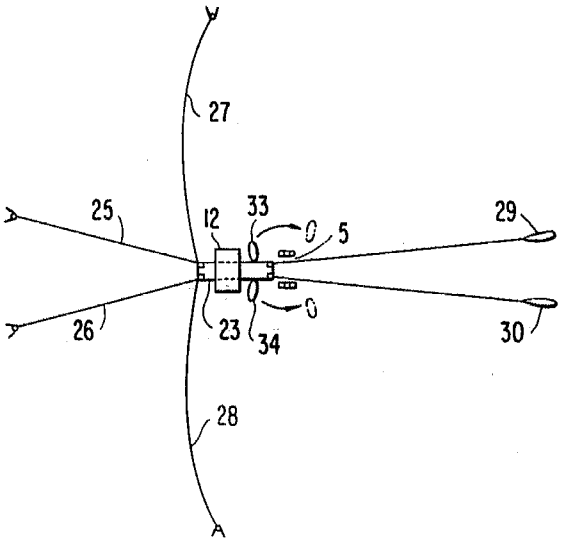
Figure 6:
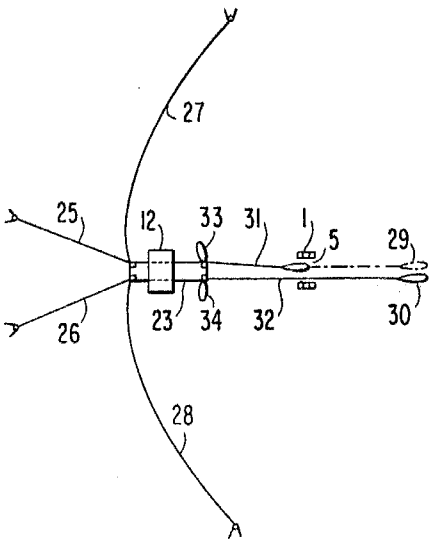
Figure 11:
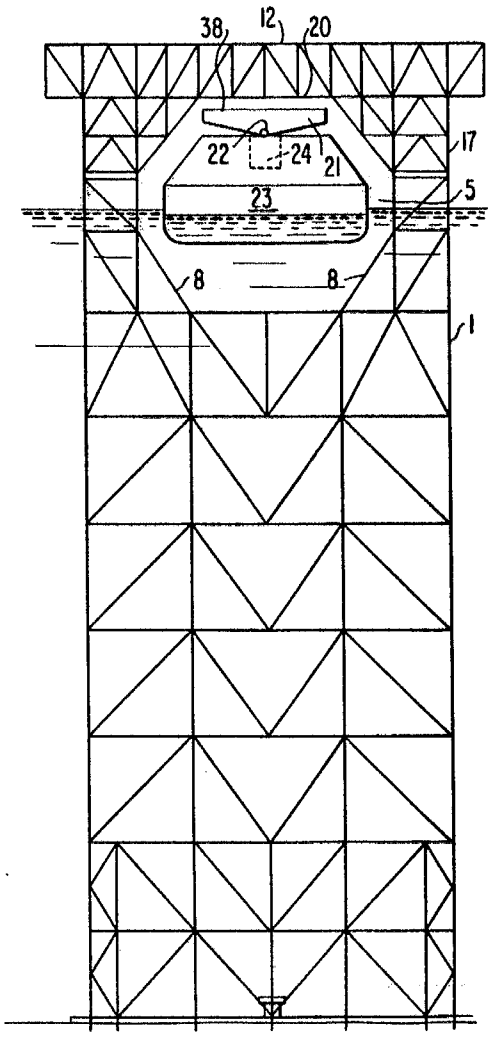
Figure 10:
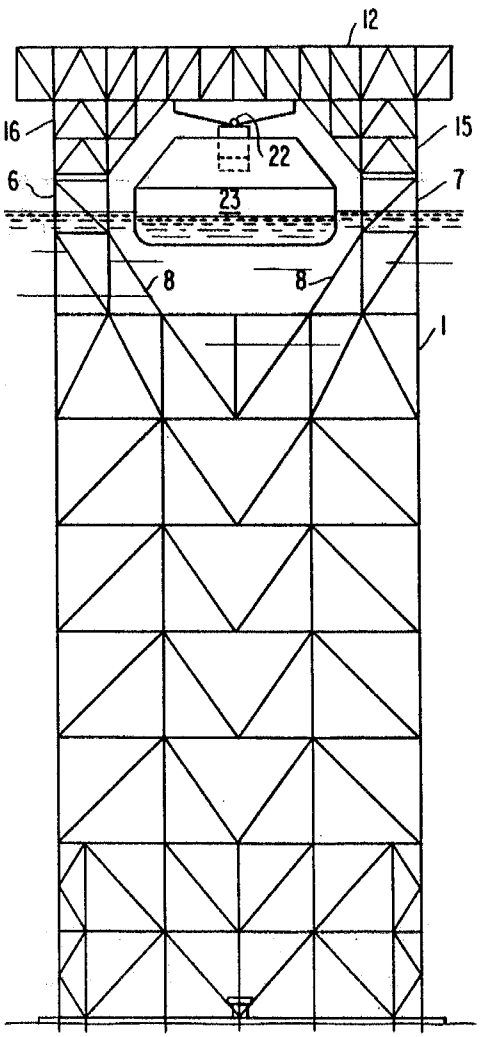
Figure 9:
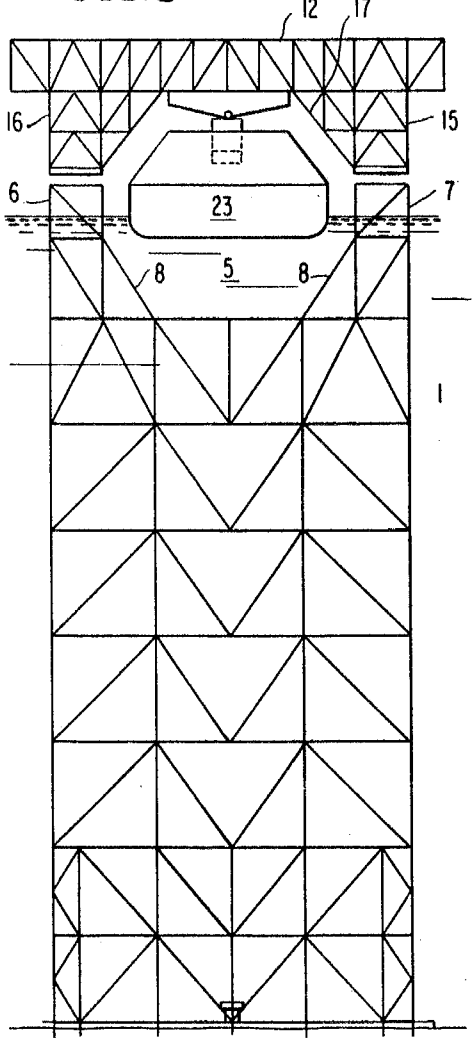
Figure 12:
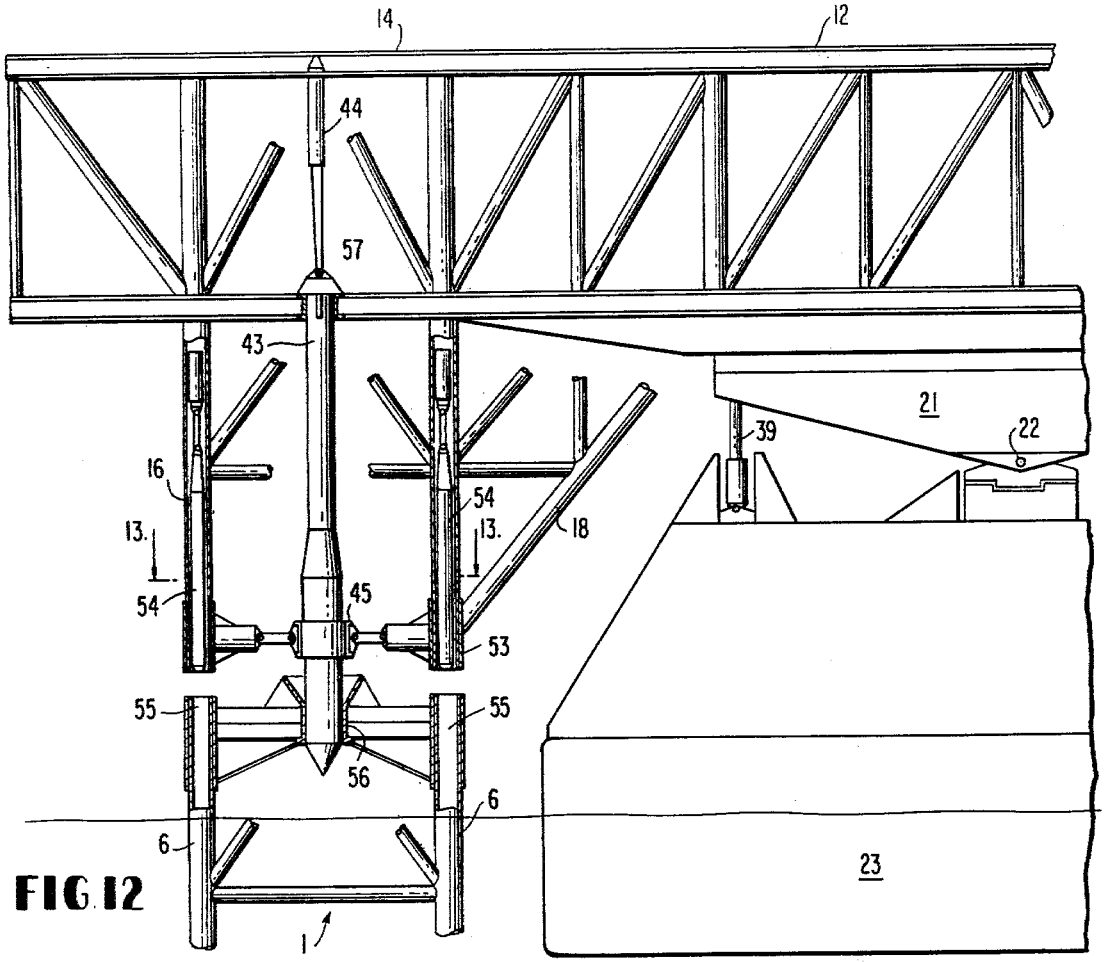
Figure 13:
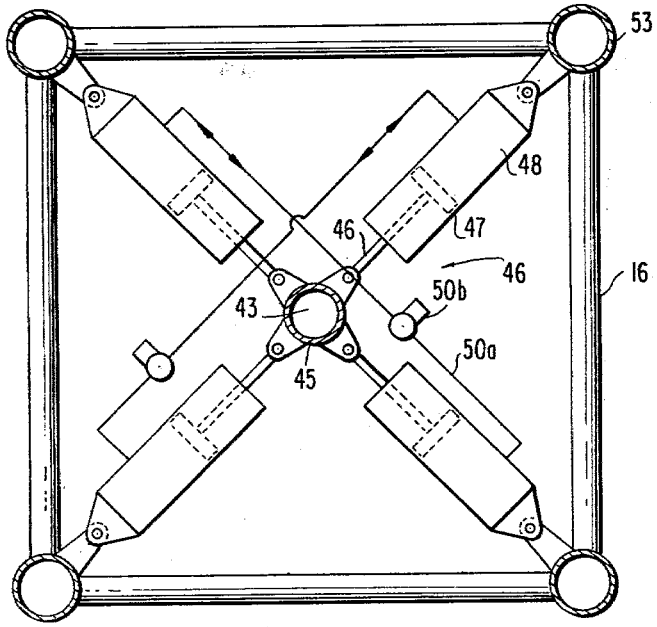
Figure 14:
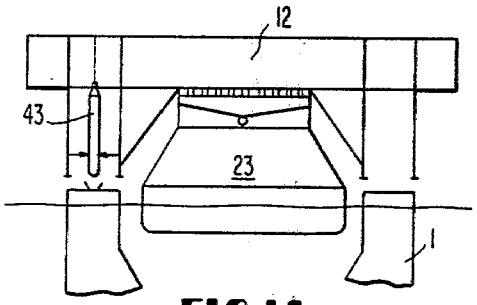
Figure 18:
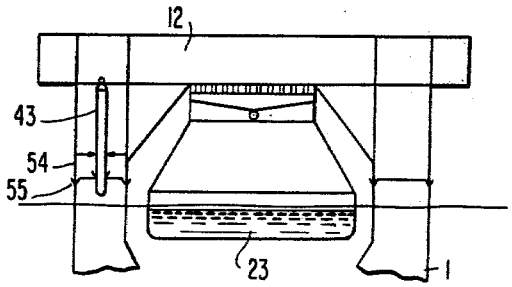
Figure 15:
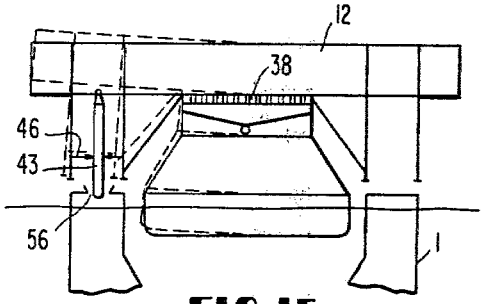
Figure 19:
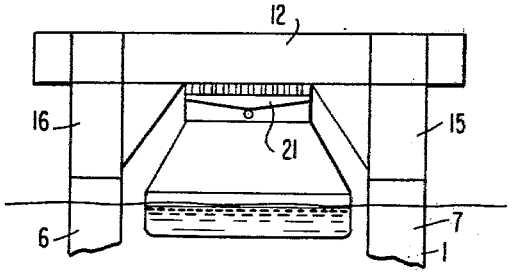
Figure 16:
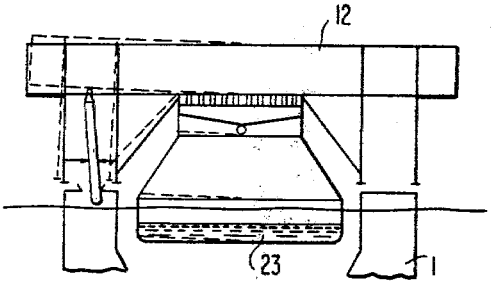
Figure 20:
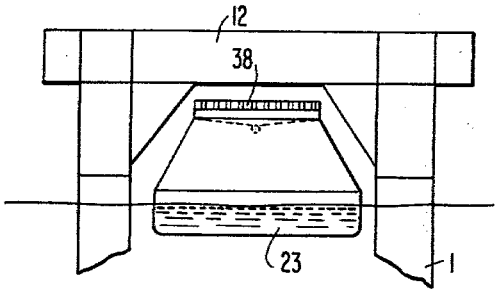
Figure 17:
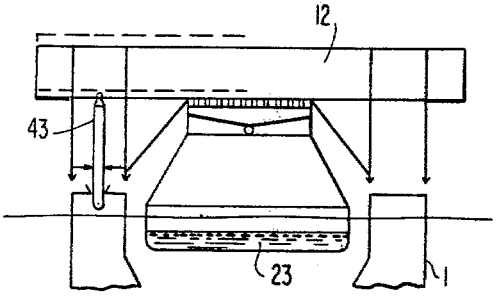
Figure 21:
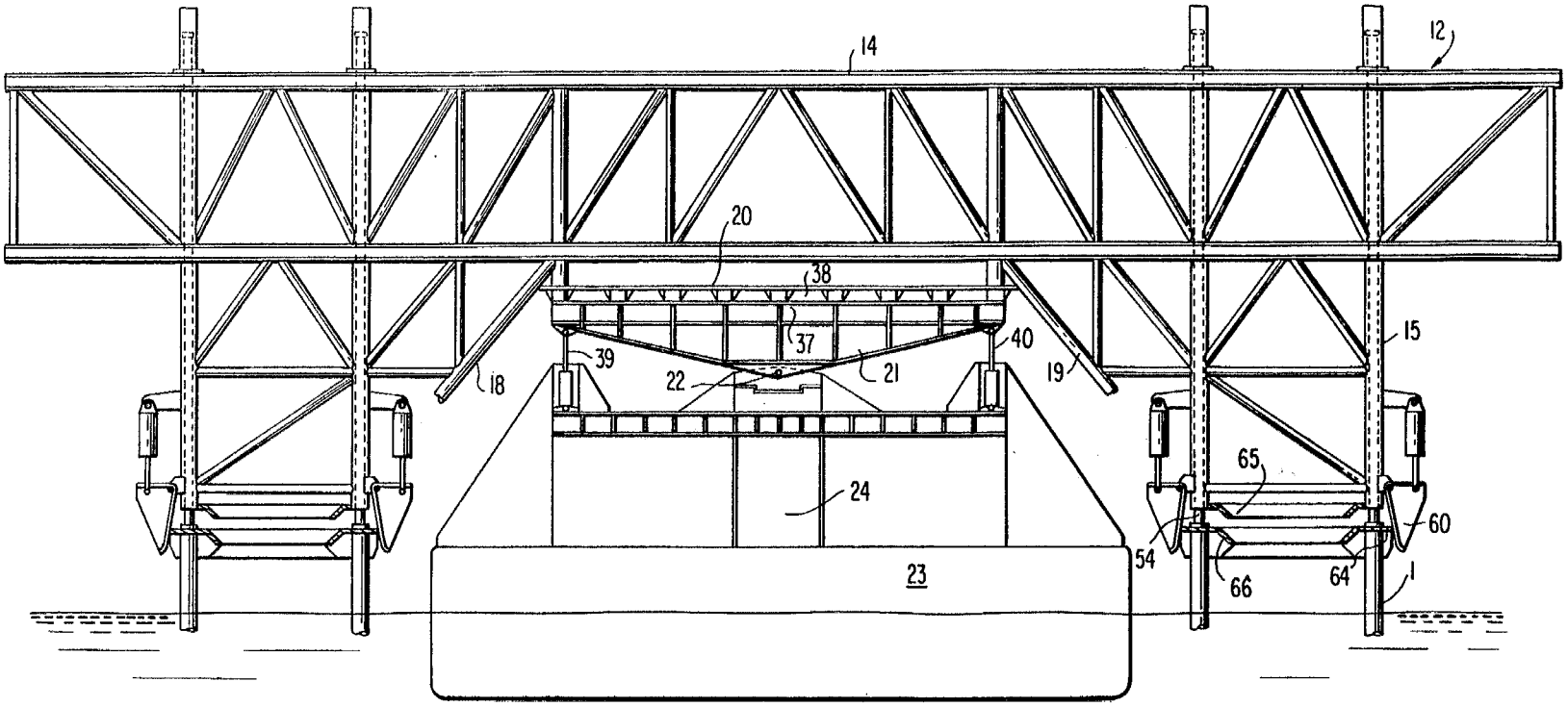
Figure 22:
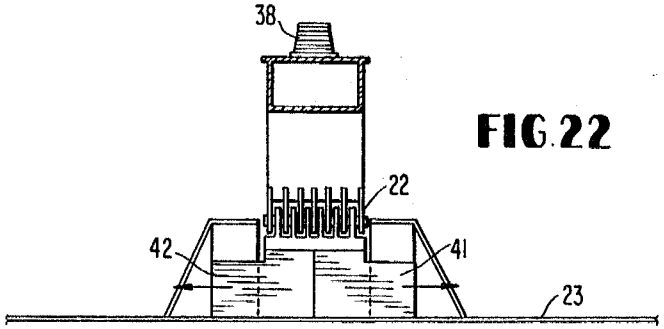
Figure 23:
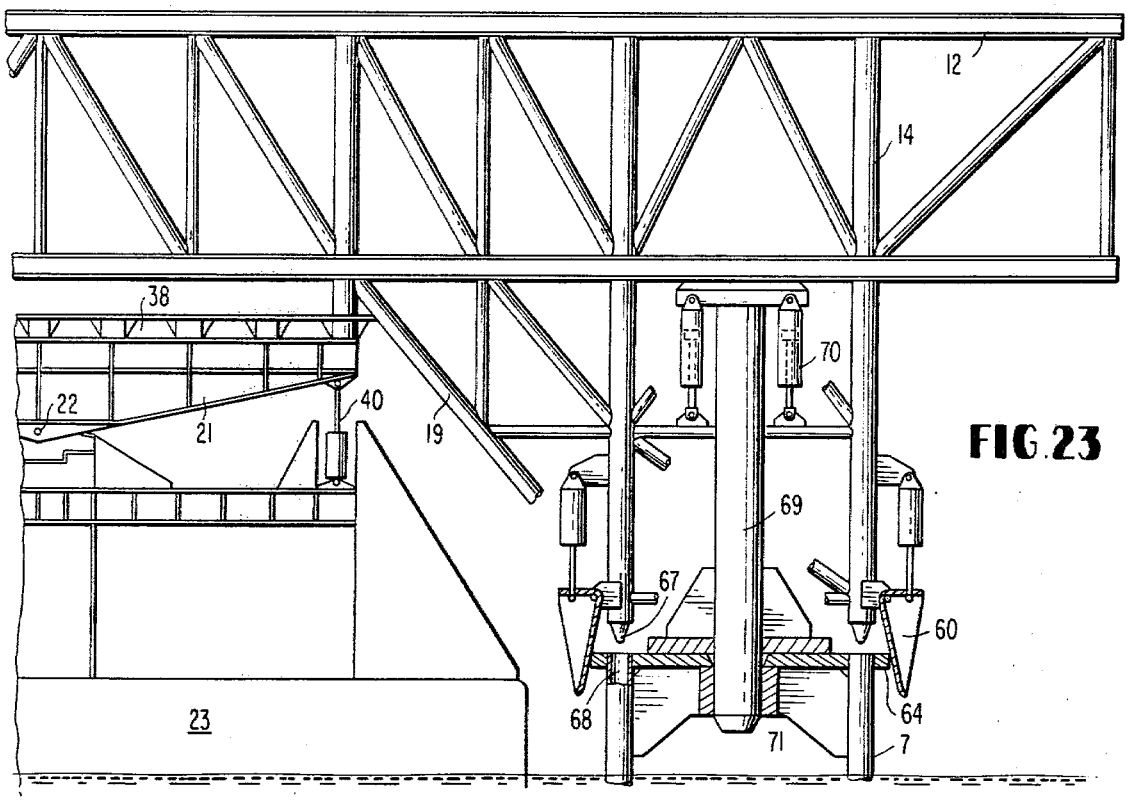
Figure 24:
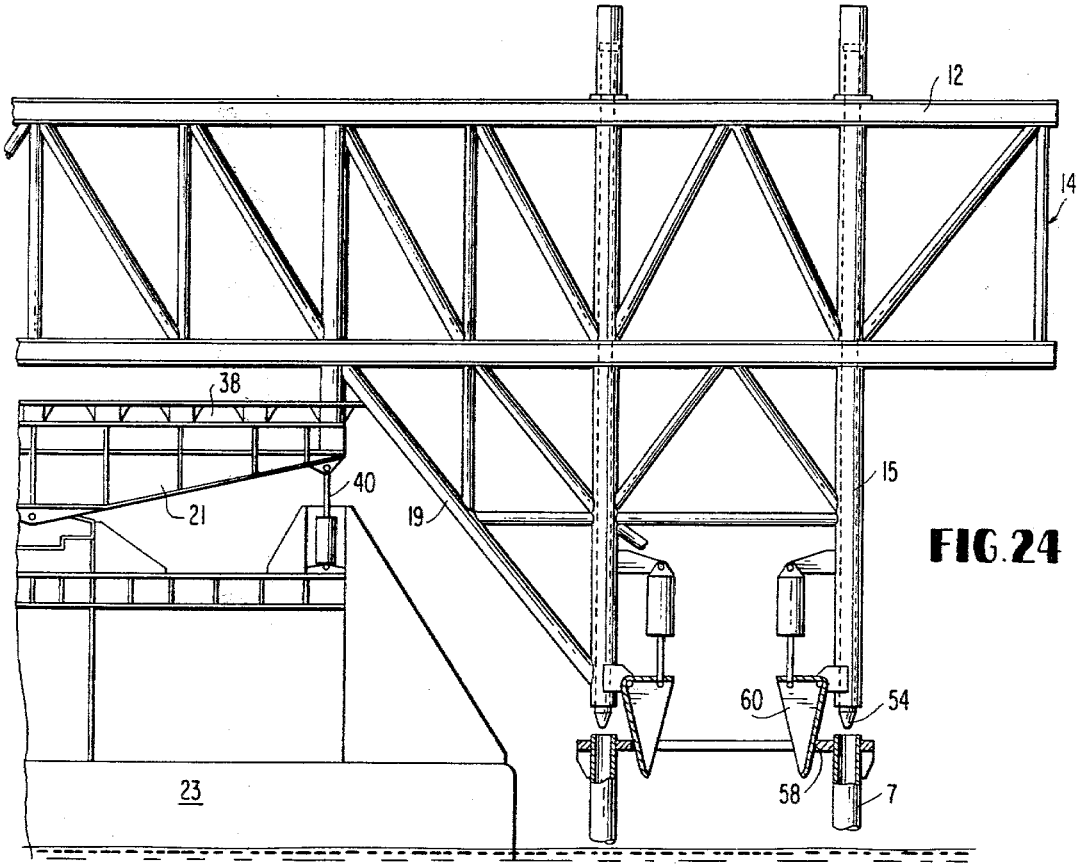
Figure 25:
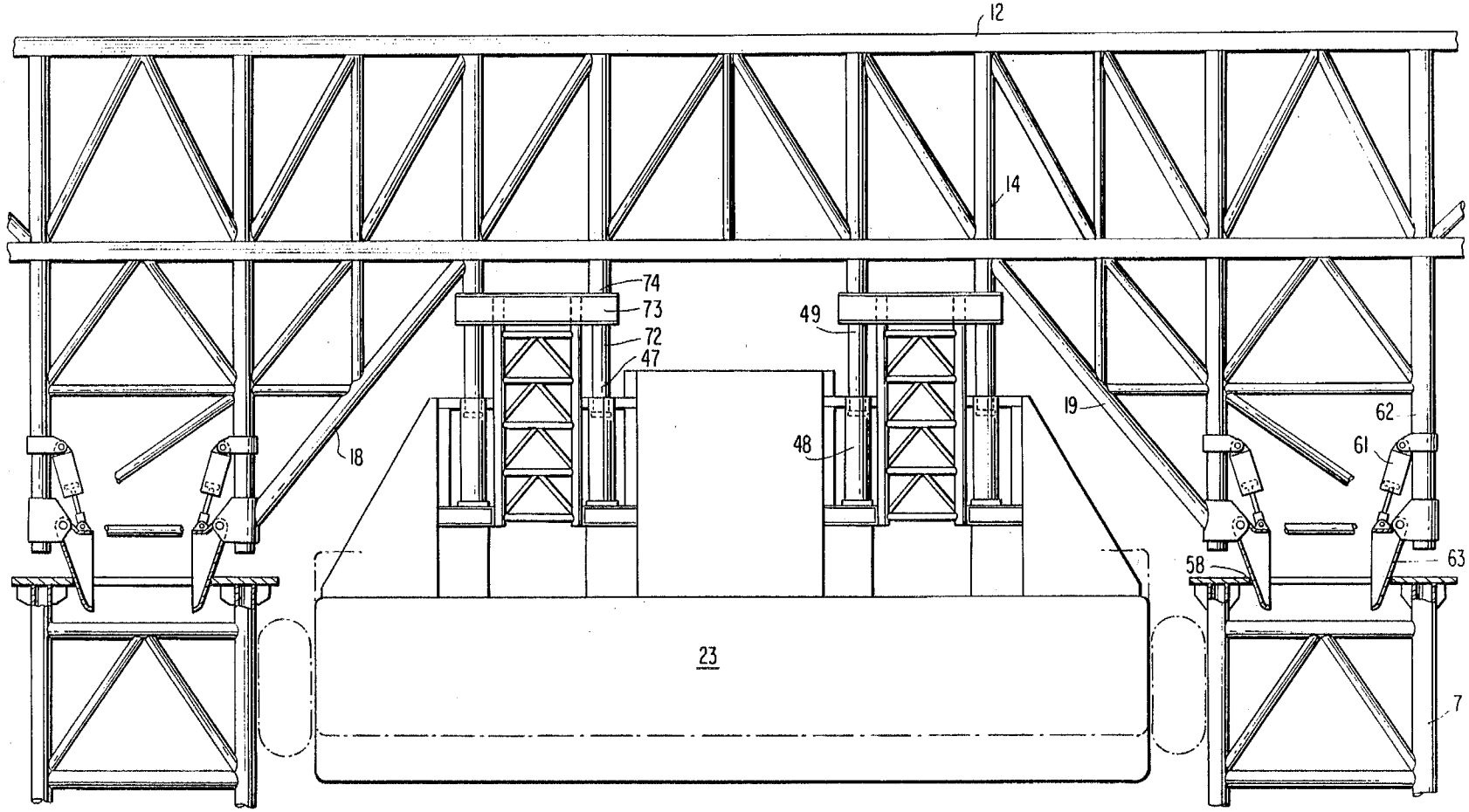
Figure 26:
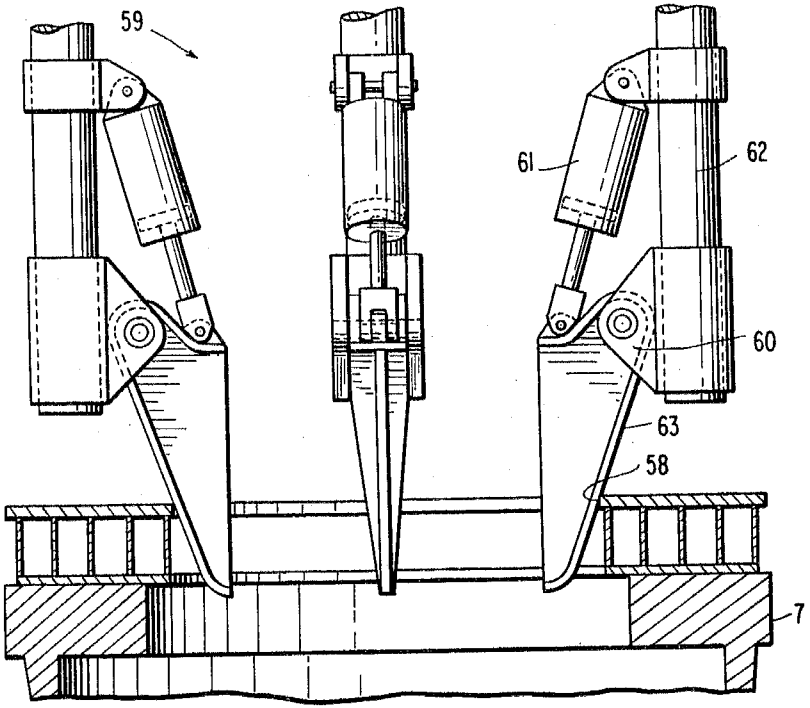
Figure 27:
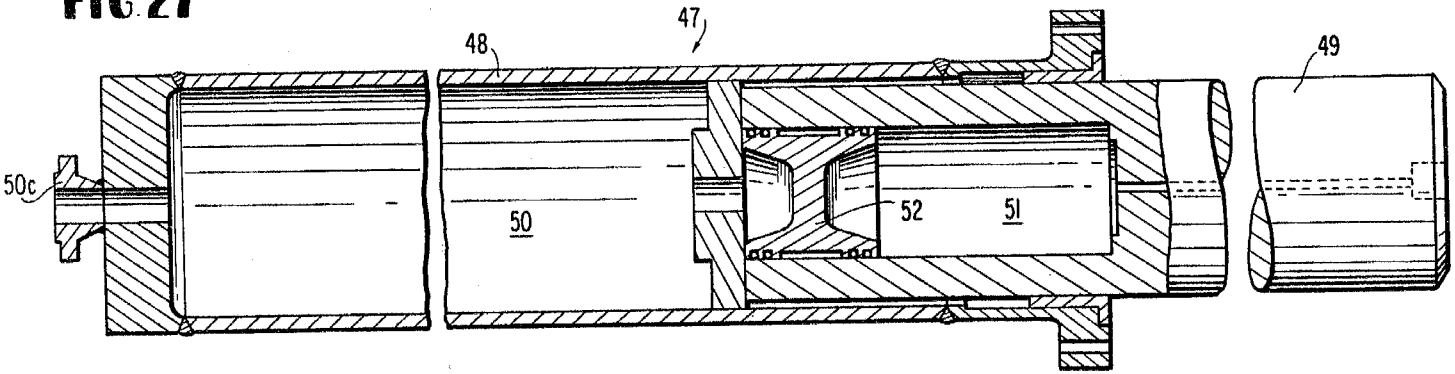
Figure 29:
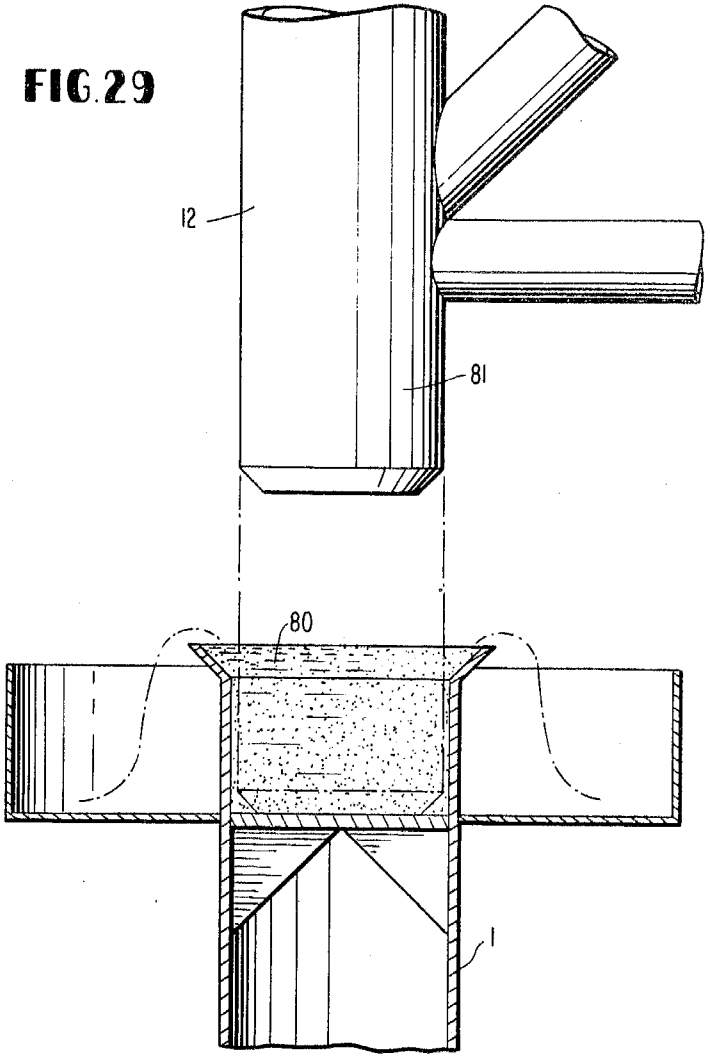
Figure 28:
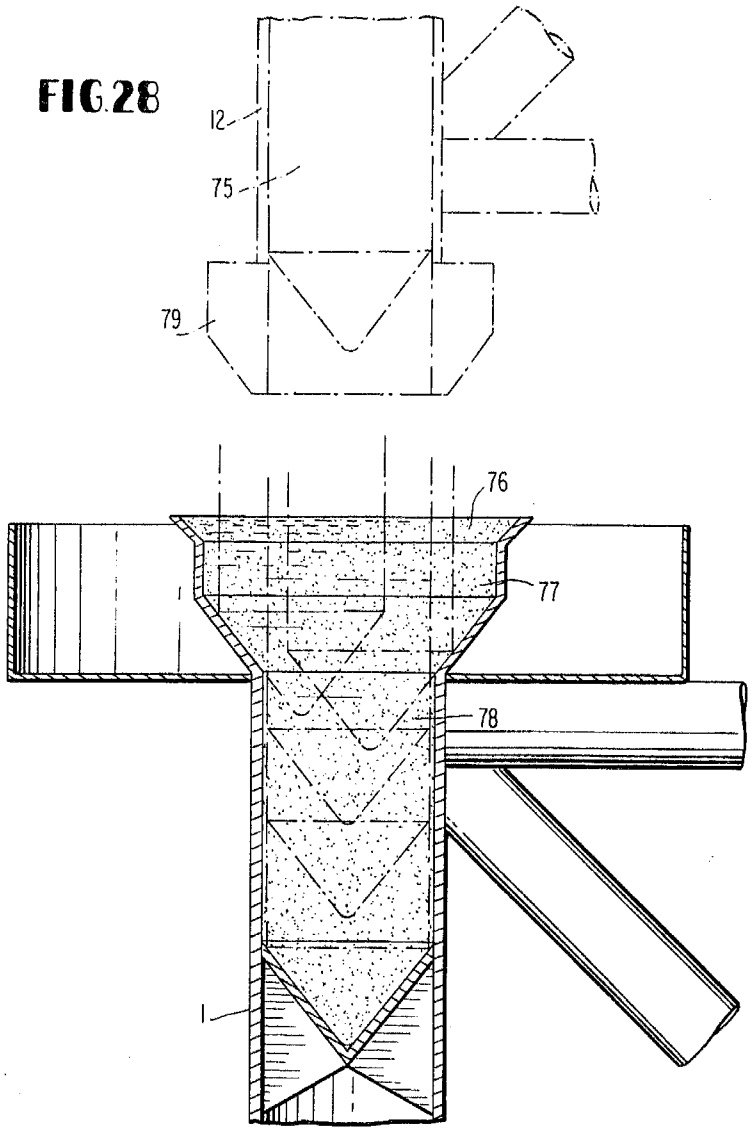

FIG. 4 provides a side elevational, schematic view of a vessel, in this case a barge, which may be employed to support an integrated deck as it is being transported to the aforenoted installed substructure for connection therewith;

FIG. 5 provides a schematic end elevational view of the FIG. 4 barge;

FIG. 6 provides, in reduced scale, a top plan view of a deck positioning operation, illustrating the manner in which tugs or maneuvering vessels are employed to commence the movement of a deck supporting barge into position over a substructure;

FIG. 7 illustrates the FIG. 6 array with the barge supported integrated deck commencing its movement into a slot or passageway in the upper portion of the substructure;

FIG. 8 illustrates the FIG. 6–7 array, with the barge having been maneuvered to the point where the integrated deck is appropriately positioned over the substructure and the barge is generally stabilized by appropriate anchor line means;

FIG. 9 provides a side elevational view of the installed substructure, illustrating the integrated deck in position for subsequent lowering or connecting operation;

FIG. 10 illustrates the manner in which the ballasting of the vessel depicted in FIG. 9 has effected lowering of the integrated deck into engagement with the substructure;

FIG. 11 schematically illustrates the manner in which the collapsing or downward movement of a rocker assembly, previously supporting the integrated deck on the vessel depicted in FIGS. 9–10, has effected rapid separation of the underside of the integrated deck from the supporting barge so as to ameliorate the effects of the wave action and form a double arch, horizontal force transmitting means at the top and base of the vessel passageway;

FIG. 12 provides a fragmentary, enlarged, elevational view, depicting a probe and shock absorber type of mechanism which may be employed to provide vertical and horizontal shock absorbing action, wave action dampening or accommodation, and desired alignment during the installation of an integrated deck on a substructure;

FIG. 13 provides a transverse sectional view of the FIG. 12 probe mechanism as viewed along section 13—13 at FIG. 12;

FIG. 14 provides a schematic, elevational view depicting the initial stage of the installation of an integrated deck, using the mechanism of FIGS. 12–13, with the integrated deck being shown above a substructure and shock absorbing and probe mechanisms in an upwardly retracted position;

FIG. 15 depicts the FIG. 14 assembly with alignment probes projected downwardly into telescoping engagement with socket means carried by the installed substructure;

FIG. 16 illustrates the FIG. 15 assembly, with ballasting of the integrated deck supporting barge having been commenced, and with the probe mechanisms, in combination with arrays of probe encircling shock absorbing means, tending to provide shock absorbing action and accommodation of wave action induced movement;

FIG. 17 illustrates the FIG. 16 array with the alignment probes having been locked or stabilized in a vertical, central alignment position and with cushioned, deck supporting rocker means dampening roll motion of the vessel;

FIG. 18 illustrates the FIG. 17 array, schematically showing the lowering of shock absorbing rams from the integrated deck into engagement with the upper side of slot defining columns of the substructure so as to provide vertical shock absorbing action and vessel motion and wave action accommodation;

FIG. 19 schematically illustrates the FIG. 18 array with the ballasting of the deck supporting barge having proceeded to a point so as to effect cushioned or shock absorbed engagement between the integrated deck and the substructure and effect the transfer of load of the integrated deck from the vessel to the substructure;

FIG. 20 schematically illustrates the FIG. 19 array, illustrating the manner in which deck supporting rocker means have been contracted downwardly rapidly, relative to the vessel, so as to effect separation between the deck supporting barge and the underside of the barge, thereby avoiding wave action induced damage;

FIG. 21 schematically illustrates an alternative mechanism for effecting shock absorbing, wave action dampening and desired alignment of the integrated deck and substructure;

FIG. 22 provides an end view of the rocker mechanism depicted in FIG. 21, schematically illustrating the removal of supporting blocks so as to permit the rapid downward movement or collapsing of the rocker mechanism;

FIG. 23 schematically illustrates, in an elevated, fragmentary format, alternative mechanism for providing shock absorbing, wave action accommodation, and desired alignment of the integrated deck and substructure;

FIG. 24 provides another fragmentary, elevational view disclosure of a shock absorbing, wave action accommodating, alignment mechanism which may be employed to facilitate interconnecting of the integrated deck and substructure;

FIG. 25 provides yet another alternative arrangement which may be employed during the lowering of an integrated deck onto a substructure to effect shock absorbing action, wave action accommodation, and desired alignment;

FIG. 26 provides an enlarged, more detailed elevational view of a shock absorbing, wave action accommodating, and alignment mechanism incorporated in FIG. 25;

FIG. 27 provides a schematic view of a hydraulically and pneumatically motivated, yieldable biasing mechanism which may be employed to provide cushioning of the alignment probes of FIG. 12 (which mechanisms are exemplary of devices which may be employed in any of the embodiments where yieldable cushioning is required);

FIG. 28 provides a schematic view of a plastically deformable socket arrangement which may be employed to provide shock absorbing, wave action accommodating, and desired alignment action during the lowering of an integrated deck onto a substructure; and FIG. 29 provides a schematic, fragmentary, elevational illustration of shock absorbing and cushioning means which may supplement the structure featured in FIG. 28 (the structures in FIG. 28 being contemplated for inclusion in the corners of an installation).

Having described the general content of drawings pertaining to presently preferred embodiments, it is now appropriate to turn to a more detailed discussion of the various inventive concepts presented through this disclosure.

DETAILED DESCRIPTION OF PREFERRED EMBODIMENTS

In describing certain preferred embodiments, as presently contemplated, the description will proceed in three stages.

In the first stage, and with reference to FIGS. 1–11, overall techniques involved in the structure and installation of an offshore facility, as proposed by the invention herein presented will be considered.

In the second stage of the presentation, and with reference to FIGS. 12–29, various methods and apparatus will be discussed which are operable to effect vertical and horizontal cushioning or shock absorbing action during the lowering of an integrated deck onto a substructure, operable to dampen wave action induced motion during this lowering operation (in relation to vessel and/or vessel supported deck movements relative to the substructure), and operable to induce desired alignment of the integrated deck during the lowering operation.

The third phase of the presentation will deal with methods and apparatus for avoiding wave action damage, with this technique involving a relatively rapid separation of a vessel from an integrated deck which has been previously transferred from a vessel to a substructure. This discussion will proceed with reference to FIGS. 10–11 and FIGS. 21–22, as well as FIG. 25.

Overall Mode Of Installation And Structure Of Offshore Installations

The discussion of overall techniques involving methods and apparatus for forming an offshore structure according to the present invention will proceed with reference to FIGS. 1–11.

Although the discussion will take place with reference to steel "jacket" and integrated deck type of substructure, it will be recognized that the discussion will be equally applicable to a wide variety of substructure and integrated deck arrangements, including structures involving steel, concrete, gravity substructure units, etc. and steel and/or concrete deck structures, etc.

Figure 1:
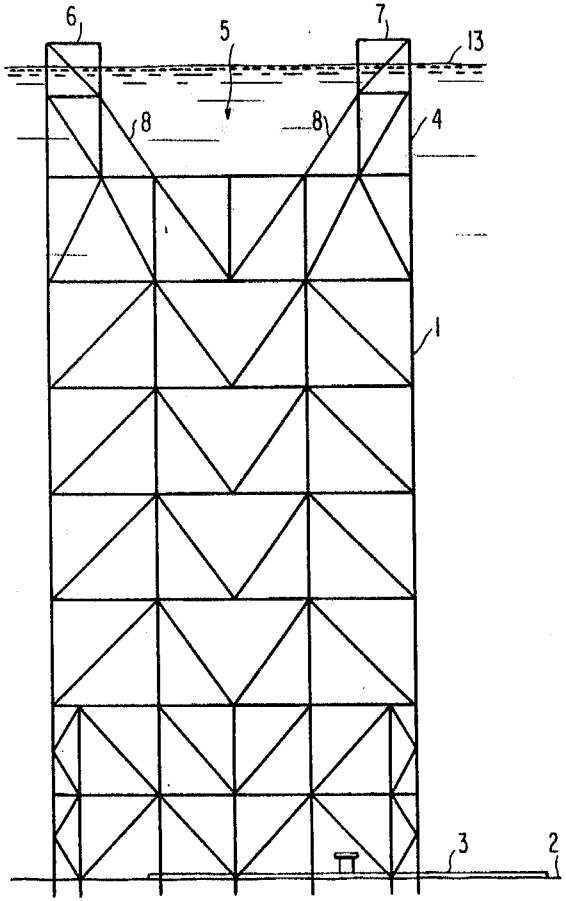

As is shown in FIG. 1, a previously fabricated jacket 1 has been transported to an offshore site, erected to a generally upright configuration and deposited on a submerged surface 2 in the general vicinity of a desired location (as defined by a previously installed well template 3).

As shown, in FIG. 1, substructure 1 includes an upper end portion 4 having a central slot 5 extending transversely therethrough so as to define a vessel passageway.

The slot 5 is defined by upwardly projecting side portion means 6 and 7 disposed on opposite sides of the slot for vessel passageway 5. (Each side portion means may comprise two or more vertical projections or columns, with at least one projection being located at each substructure corner.

An arch-like, horizontal force transmitting, arrangement 8 defines the base of vessel passageway 5 and serves to provide horizontal or lateral force transmitting communication between side portions 6 and 7 of the substructure 1.

Figure 2:
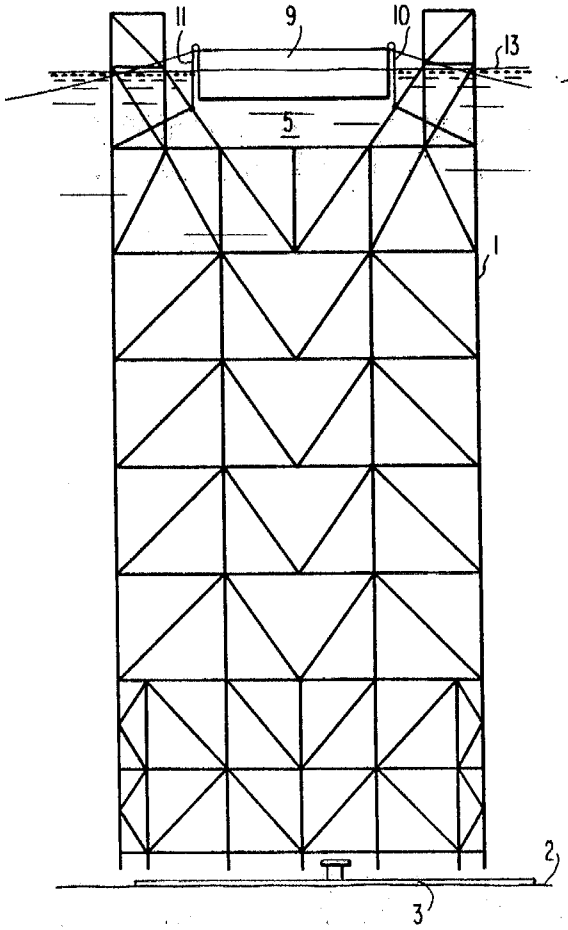
FIG. 2 depicts the FIG. 1 substructure supported from a maneuvering vessel which has been maneuvered into position in a vessel passageway formed in the upper portion of this substructure, with the substructure connected to the vessel by appropriate hoisting and lowering cable means.

As is shown in FIG. 2, a vessel, which may comprise a barge 9 manipulated by appropriate winch controlled anchor means, may be moved into passageway 5 and connected with the jacket 1 by an array of appropriate hoisting and lowering lines 10 and 11.

The hoisting lines 10 and 11 may be manipulated from vessel 9 so as to raise jacket 1 to a floating position (if it was not originally floating at the time the vessel 9 moved into the slot 5).

With the jacket 1 stabilized relative to the vessel 9, i.e. connected thereto by the cable means 10 and 11, the anchor lines associated with the vessel means 9 may be manipulated so as to cause the vessel 9 and jacket 1 to be moved into a desired position directly over the desired installation position 3 on the sub-surface 2.

Figure 3:
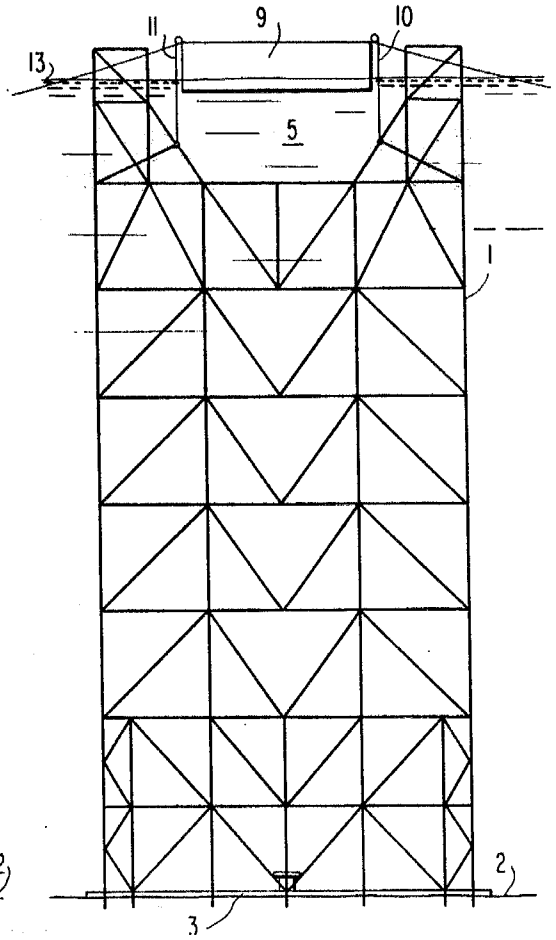
FIG. 3 depicts the FIG. 2 assembly after the hoisting cable means has been manipulated so as to lower the substructure over a desired site such as a well template, such lowering occurring after the vessel has maneuvered the substructure into position over the desired location.

FIG. 3 depicts the assembly, now under consideration, with the cable means 10–11 having been operated so as to lower the jacket 1 from the vessel 9 directly over the desired installation 3 in the form of the well template.

As will be understood, and following conventional practices, the substructure 1, if it is not a gravity base type requiring no piling type connection, may be connected to the submerged surface with appropriate piling.

At an appropriate time, but in any event prior to the subsequently described deck installation operations, the vessel 9 will be disconnected from the jacket 1 and moved out of the vessel passageway 5.

With the jacket 1 or substructure 1 having been installed at the desired position, it now becomes appropriate to consider the manner in which an integrated deck 12, schematically shown in FIGS. 4 and 5, may be installed on the upper side portion means 6 and 7 of the substructure 1.

As shown in FIGS. 1–3, the upper ends of the side portion 6 and 7 project above the water surface 13 so as to provide surface means above the water surface which are operable to receive the integrated deck structure 12.

As is depicted in FIGS. 4 and 5, integrated deck structure 12 may be generally downward concave in configuration on its underside, and include an upper generally horizontal deck portion 14, downwardly extending side or column portions 15 and 16 and a downwardly concave, and lateral force transmitting, generally arch-like underside 17.

Arch-like underside 17 is defined by transversely extending framing means 18 and 19 extending from lower base portions of side portions 15 and 16 laterally and upwardly to a mid portion 20 of the underside of the upper horizontal deck 14. Framing means 18 and 19 are operable to transmit laterally or horizontally directed force between deck 14 and substructure 1 in the completed installation.

As is shown in FIG. 5, deck 12 is supported in a flat mid portion 20 of the horizontal deck portion 14 by one or more pivotable rocker beam assemblies 21.

Rocker assemblies 21, as will be subsequently described, are pivotable about a pivot axis 22 on a support vessel 23, which vessel may comprise an anchor line manipulated barge.

Rocker means 22 may be hydraulically and/or pneumatically and/or otherwise cushioned with respect to wave action induced rolling movement of barge 23 about the longitudinal median plane of the barge, as permitted by pivot means 22.

As will also be described hereinafter, after the deck 12 has been lowered so as to interconnect deck side portions 15 and 16 with substructure side portions 6 and 7, rocker means 21 may be moved downwardly relative to barge 23 so as to effect rapid separation between the underside area 20 and the top of the rocker means 21.

This downward "collapsing" movement of the rocker assembly means 21 may be effected by the schematically illustrated hydraulic, ram type lowering means 24 depicted in FIG. 5, for example.

As shown in FIGS. 4 and 5, integrated deck 12, comprising a one piece deck installation, is supported on vessel 23 so that the horizontal force transmitting means 17 (comprising arch framing means 18 and 19) extends laterally beyond side portions of the vessel 23 and is disengaged therefrom.

This is true with respect to the downwardly concave, lateral force transmitting arch-like means 17, as well as with respect to the upwardly concave lateral force transmitting arch-like means 8, when the barge or vessel 23, supporting the deck 12, has been maneuvered so as to bring the deck 12 into position superposed above the substructure 1 as depicted in FIGS. 9–11.

At this juncture, it is appropriate with reference to FIGS. 6–8 to consider a representative manner by which the vessel 23 may be manipulated so as to cause it to enter the vessel passageway 5 and bring the deck structure 12 into position over the substructure 1, with downwardly depending deck columns or side portions 15 and 16 (each of which may comprise one or more separate columns or legs) being superposed generally above the upwardly projecting side portions 6 and 7 of substructure 1 (each of which may comprise one or more columns, etc.).

As shown in FIG. 6, the deck 12 may be supported on vessel 23, with winch control anchor lines 25, 26 being connected with the stern of the vessel 23. Laterally extending anchor lines 27 and 28, also winch controlled, extend laterally from the stern of the vessel 23, as depicted in FIG. 6 so as to provide overall stabilization for the stern of the vessel 23.

Tug boat means 29 and 30, connected with the bow of vessel 23 by tow lines 31 and 32 passing through vessel passageway 5, provide a mechanism for drawing the vessel 23 into the vessel passageway 5 of substructure 1, Supplemental tugs 33 and 34 may be employed to stabilize the bow of vessel 23 during this "drawing-in" manipulation.

As shown in FIG. 7, the lead tugs 29 and 30 serve to draw the vessel 23 into the slot 5. As the vessel 23 commences to enter the slot 5, the side stabilizing tugs 33 and 34, as indicated in FIG. 7 may move to the phantom line positions there shown where they may pick up forward lateral anchor lines 35 and 36, and maneuver these forward anchor lines to the positions shown in FIG. 8.

As will be understood, during this operation, the aft anchor lines 25–26 may be paid out under appropriate winch control, with position controlling tension being maintained by lateral lines 27–28.

As shown in FIG. 8, during the final maneuvering of vessel 23, intended to generally precisely position the deck 12 over the substructure 1, the side tugs 33 and 34 may be connected by tow lines to the lead tugs 29 and 30 so as to facilitate steering or maneuvering of the latter.

As will be apparent, a variety of vessel manipulating techniques and operations may be employed to effectively move the deck supporting vessel or barge 23 into the slot or passageway 5 so as to bring the deck 12 into appropriate position, superposed directly above the substructure 1.

With the deck 12 positioned as shown in FIG. 8, superposed above substructure 1, the deck 12 may be lowered into engagement with the substructure 1. This operation will now be discussed with reference to FIGS. 9–11.

FIG. 9 depicts, in elevation view, the relative position of the deck 12, vessel 23, and substructure 1 in the FIG. 8 configuration.

In this configuration, the lateral force transmitting arch means 17 and 8 are disposed so as to overlie and underlie the vessel 23 and define upper and lower lateral force transmitting portions of the deck 12 and the vessel passageway 5.

By appropriate ballasting of the barge 23, as depicted in FIG. 10, the barge and deck 12 may be lowered so as to bring the deck side portions 15 and 16 into engagement with the upwardly projecting side portions 7 and 6 of the substructure 1.

This operation may be effected at a relatively slower rate than the subsequent operation, described in connection with FIG. 11 or, i.e. slower than the rate of barge and deck separation as described in connection with FIG. 11.

In any event, it is contemplated that during the lowering of deck 12, as depicted in FIG. 10, and as will be described in a succeeding section of this discussion, horizontal and vertical force interactions between the deck 12 and substructure 1 will be cushioned or shock absorbed, wave action induced movement of the vessel 23 and/or deck 12 relative to the substructure 1 will be dampened and or compensated for and/or accommodated, and the proper alignment of the side portions 15 and 16 relative to the substructure side portions 7 and 6 will be effected and maintained.

As shown in FIG. 11, after the deck 12 has been engaged with the substructure 1, and the load of the deck 12 effectively transferred from the vessel 23 to the substructure 1, relatively rapid separation between the vessel 23 and the underside of the deck 12 will be effected.

As previously noted, and as will be discussed subsequently in greater detail, this relatively rapid separation may be effected by downward movement of the deck supporting rocker means 21, as permitted by hydraulic and/or pneumatic lowering ram means 24.

As will be appreciated, the completed offshore structure depicted in FIG. 11 is characterized by a vessel passageway 5 which is bounded on the top and bottom by lateral force transmitting arch-like means 17 and 18.

These arch-like means provide effective strengthening of the side portions of the upwardly projecting portion of the substructure 1 and the span 14 of deck 12, and enable the deck 12 to be fabricated with less structural material than would be involved in connection with a flat, deck arrangement.

In this connection, it should be noted that throughout the installation operation, neither the upper arch-like means 17, nor the lower arch-like means 8 imposes lateral loading on the deck installing vessel means 23, with side portions 15-16 and 6-7 remaining free at all times to undergo limited horizontal flexing or displacement necessary to accommodate the setting of the mid point supported deck 12 on the side portions 6 and 7 of the substructure 1.

At this point it is appropriate to give consideration to the shock absorbing, wave action dampening, and deck alignment mechanisms which facilitate the FIG. 10 step, noted above.

Methods And Apparatus For Effecting Vertical And Horizontal Cushioning (Shock Absorbing), Wave Action Induced Motion Dampening, And Deck Alignment In describing various cushioning, wave action dampening, and aligning techniques contemplated through this disclosure, reference will be made to various embodiments depicted in FIGS. 12–29.

Turning first to FIGS. 21 and 22, additional comments will now be offered with respect to the "collapsing" rocker means assembly 21.

As shown in FIGS. 21 and 22, one or more rocker means 21 serve to support the flat, underside 20 of the mid portion of the upper horizontally extending deck portion 14 of the integrated deck 12.

The upper portion 37 of each such rocker means 21 may be provided with a series of shear force absorbing, elastic pad means 38. Such elastic pad means would be operable to absorb lateral shear forces between the integrated deck 12 and the vessel 23, developed as a result of wave action forces or interaction between the deck 12 and the substructure 1 during the deck setting operation.

Rocker beam means 21 are pivotable about an axis 22 extending generally longitudinally of the vessel 23. Such pivotable or rocking movement, which may serve to accommodate relative motion between the vessel 23 and the deck 12 caused by wave action, may be cushioned by hydraulic and/or pneumatic cushioning cylinder means 39 and 40, schematically depicted in FIG. 21, or by other yieldable cushioning means.

The pivot means 22 for each rocker beam 21 may be supported upon a vertically reciprocable piston and cylinder assembly 24, as schematically shown in FIG. 21.

During transport of the deck means 12 on vessel 23, the position of pivot means 22 may be fixed by supporting block means 41 and 42, as illustrated generally in FIG. 22. (Indeed, conventional tie-down and blocking means may be employed during back transport and removed for deck installation).

At such a point in time as it is desired to effect the rapid separation of the rocker beam means 21 from the underside 20 of the integrated deck 12, as described in connection with FIG. 11, the block means 41 and 42 may be moved laterally away from their supporting position in relation to the pivot 22, as schematically shown in FIG. 22, with piston/cylinder means 24 being actuated to permit relative rapid (and desirably cushioned) lowering of the pivot means 22.

Having described the rocker beam means structure, it is now appropriate to return to the shock absorbing, motion dampening, and alignment concept depicted in FIGS. 12–13.

As shown in FIG. 12, the composite cushioning, motion dampening, and alignment device here involved includes a probe means 43 suspended by a lowering mechanism 44 (possibly of the cable type) from deck portion 14 (one such probe being located at each deck corner). Probe 43, normally retracted upwardly from the position depicted in FIG. 12, passes telescopingly through a stabilizing collar 45 which is engaged by a circumferentially arranged array 46 of circumferentially displaced cushioning ram assemblies 47.

As shown in FIGS. 12 and 13, the rams 47 of the cushioning ram assembly 46 may extend from corner portions of each column of each side portion 15 and 16 (which may be located at each corner of the substructure and deck), generally horizontally inwardly to the collar 45. Each ram assembly would be pivotably connected at each end to the corner of such column frame means and the probe collar 45.

The hydraulic and/or pneumatic circuitry of each of the ram means 47 may be such as to permit horizontal displacement cushioning of the collar 45 in a multidirectional manner, while accommodating relative displacement of the collar 45 due to wave action.

A representative cushioning ram structure is illustrated in FIG. 27 and may comprise a cylinder means 48 pivotably connected with a corner of structure 16 or 15, with piston 49 extending from cylinder 48 and being pivotably connected by way of appropriate linkage means to collar 45.

Cushioning system 46 may be of the "passive" type, with the interior 50 each cylinder 48 being filled with hydraulic liquid but not connected with a pump. An internal cavity 51 may be contained within piston 49, with a floating piston 52 separating cavity 51 from cavity 50. The function of cavity 51, which would be charged with pressurized gas, would be to provide a yieldable cushioning action, supplementing the hydraulic cushioning provided by liquid chamber 50.

Such hydraulic cushioning may result from the interconnection of opposing cylinder cavities as shown in FIG. 13. As there shown, the cavities of opposing ram cylinders are connected by valve controlled, conduit means 50*a*. With this arrangement, wave action, or otherwise induced horizontal shifting of the collar 45 will effect restricted flow, liquid pumping between the cavities of opposed cylinders, thereby cushioning shock and dampening movement. With the collar 45 centered, and the valve 50*b* of each conduit means 50*a* closed, the collar will be substantially "locked", so as to stabilize a centered, vertical position of the telescopingly associated probe 43. In this "locked" condition, the pressurized gas cavities 51 will afford some residual cushioning action.

Composite biasing and cushioning units of the type shown in FIG. 27 may be employed in a variety of formats in different embodiments of this invention where biasing coupled with cushioning action may be desirable. Where "non-passive" cushioning action is required, a cylinder end opening 50*c* may be connected with a controlled vent and/or source of pressurized liquid, depending on the nature of the movements involved.

Before describing the overall mode of operation of the FIG. 12–13 mechanism, it will also be noted, with reference to FIG. 12, that each of the corners 53 (usually 4) of each corner structure such as a corner column or post of means 16, may contain cushioning and shock absorbing ram means 54 (which may be of the ram structure type generally described in connection with FIG. 27 with opening 50*c* connected to a restricted flow outlet, or may be of other hydraulic and/or pneumatic or other shock absorbing characteristics).

In any event, the cushioning rams 54 contained in the corner posts 53 are operable to be extended downwardly from the retracted position shown in FIG. 12 so as to be inserted into and locked within deck alignment sockets 55 in corner portions of the upper end of substructure means 1, as generally shown in FIG. 12.

As shown in FIG. 12, each substructure corner portion may be provided with a generally centrally located, probe engageable socket 56 operable to telescopingly receive and laterally but not vertically restrain the lower end of a probe 43, when the probe 43 is lowered to the extended position depicted in FIG. 12.

Having described the general structure of the mechanism featured in FIGS. 12–13, a representative mode of operations of this structure will now be discussed with reference to FIGS. 14–20.

FIG. 14 depicts the FIGS. 12–13 assembly in the condition described with FIG. 9.

As there shown, the vertical cushioning rams 54 are retracted, as are the alignment probes 43, at each corner of the substructure 1 and deck 12.

FIG. 15 depicts the manner in which, with the probes 43 are projected downwardly into telescoping engagement with the socket means 56, with the cushioning arrays 46 being operable to provide lateral shock absorbing action and dampen wave action.

Because the probes 43 are pivotably supported by hoisting means 44 at their upper ends 57, as shown in FIG. 12, and because the sockets 56 accommodate some tilting movement of the lower ends of the probes 43, the probes are free to undergo lateral and tilting movement of a shock absorbing nature, with the ram assemblies 46 providing appropriate cushioning action. in certain instances, where an "active" cushioning array 46 might be employed, appropriate hydraulic circuitry may be employed to provide balance biasing forces on each of the cushioning ram means 47 so as to tend to yieldably bias the ram collar 45 to a centralized position, thereby tending to maintain desired conditions of alignment.

As will also be understood, the elastomeric pad means 38 will also provide horizontal shock absorbing action between the barge 23 and the deck 12, functioning in shear to accomplish this objective.

With the probe 43 lowered and telescopingly engaged with the substructure socket means 56, ballasting of the barge may be initiated, as generally depicted in FIG. 16.

After a desired increment of barge or vessel ballasting has been effected, the circuitry 50*a*, 50*b* associated with the ram means 47 may be operated so as to lock the collars 45 and probes 43 in the centered position shown in FIG. 13. This substantially locks the probes 43 in a centralized alignment position, operable to insure appropriate mating of deck and substructure, mutually engageable portions during the final lowering aspects of the deck setting operation.

With the probes 43 centralized, as shown in FIG. 17, (this may be facilitated by manipulation of barge 23) so that desired alignment conditions are obtained, the cushioning rams 54 may be lowered downwardly into locked engagement with the socket means 55 of the substructure as generally depicted in FIG. 18. With the ram means 54 thus lowered and engaged with the substructure, appropriate vertical cushioning action is provided in relation to the final lowering stage involving the setting of the deck 12.

FIG. 19 illustrates the assembly after the ballasting of the barge 23 has proceeded to the point where the alignment controlled and cushioned lowering of the deck 12 has been completed, so as to bring the deck portions 16 and 15 into abutting and aligned engagement with the substructure portions 6 and 7.

Such engagement may involve inter engagement between mating frustoconical or socket portions engageable between the deck 12 and substructure 1.

With the deck 12 fully engaged with the substructure 1, the rocker beam means 21, shown in FIG. 19, may be collapsed or moved downwardly as permitted by the hydraulic lowering means 24 so as to effect the previously noted, relatively rapid separation of the vessel 23 from the underside of the integrated deck 12.

FIGS. 21–26 depict various alternative lowering control arrangement, each employing an array 59 of circumferentially displaced, biased flappers, wedges, or cam like structures 60. Such cam means may be carried by the integrated deck and be operable to be projected downwardly so as to define a generally frustoconical array of cushioning means, engageable with circumferentially displaced portions of deck engageable base means carried by upper portions of the substructure 1.

Turning first to FIG. 26, it will be appreciated that the base means may comprise a generally circular wall means 58 carried on a substructure corner portion. (FIG. 26 shows on alternative concrete structure 7, while other figures show steel arrangements, by way of example).

A circumferentially displaced array 59 of yieldably biased cushioning wedges 58 is operable to cooperate with the base means 58 so as to provide vertical and horizontal cushioning action, accommodate wave action by inducing dampening thereof, and tend to center mating portions of the deck with engageable portions of the substructure.

As shown in FIG. 26, the array 59 may comprise four (three only shown in elevational view of FIG. 26), pivoted wedge or cam means 60. Each such pivoted wedge or cam means 60 is connected by cushioning and biasing ram means 61 (which may be interconnected so as to be similar to the previously described array 46, or ram means 47 or which may function as individual, yieldable cushioning units) to framing means 62 of corner post portions of the underside of the integrated deck 12.

Hydraulic mechanisms 61 may be operated by appropriate circuitry so as to retract the wedge or cam means 60 to an upward position, from the downwardly extended position shown in FIG. 26, when the barge and deck are being transported.

With the wedge means projected downwardly, as shown in FIG. 26, they cooperate to define a circumferential array of inclined cam-like, wedge surface means 63 which are yieldably engageable with the base means 58 during the deck lowering operation. This yieldable engagement, because of the generally inclined or frustoconical orientation of the various wedge surface means 63, provides both horizontal and vertical cushioning action as well as a general centralizing action. Moreover, because the individual cam or wedge means 60 are free to undergo cushioning movement, wave action induced movement of the vessel 23 and deck 12 (rolling, etc.) will be able to be dampened or accommodated.

With the basic structure of the pivoted wedge or cam arrangement having been described, it is now appropriate to turn to various different embodiments of this concept as featured in FIGS. 21–25.

As shown in FIG. 21, for example, the wedge means 60 cooperate with an external circle-like base means 64, as does the array of wedge means 60 depicted in FIG. 23.

However, in the embodiments featured in FIGS. 24 and 25, like the arrangement shown in FIG. 26, the pivoted wedge means 60 biasingly and yieldably engage internal circle, defining base means 58.

Other differences with respect to various techniques for practicing the invention will be apparent with respect to the embodiments featured in FIGS. 21–25.

For example, in the FIG. 21 and FIG. 24 arrangement, extendable cushioning ram means 54 are projectable from the integrated deck means 12 so as to engage mating socket portions of the substructure and permit cushioned lowering of the deck 12 and transfer of the load of the deck 12 from the vessel 23 to the substructure 1 under controlled conditions.

With respect to the mode of mating engagement between the deck 12 and the substructure 1, FIG. 21 provides a representative illustration of generally matable frustoconical means 65 and 66 which are carried internally of deck and substructure corner portions. And, as shown in FIG. 23, for example, instead of employing continuous frustoconical mating surfaces, circumferentially displaced mating cone 67 and socket 68 arrangements may be utilized in corner columns of each corner post area of the offshore structure.

It is also possible that such mating socket type arrangements may be dispensed with, and flush engagement between engageable portions of the deck and substructure be employed.

It should also be noted that a variety of vertical cushioning and lowering control mechanism may be employed, in addition to or instead of the vertical cushioning as provided by the projectable ram means 54.

For example, as shown in FIG. 23, a centering ram 69 may be projected downwardly by cushioning cylinder means 70 into wedge-locked engagement with a substructure socket means 71. The ram manipulating means 70 would be operable to provide control or cushioning action, permitting lowering of the deck 12, with cushioning action taking place at the upper end of the centering rams 69 through action of the cushioning or shock absorbing means 70.

As will be appreciated, the cushioning action controlling the final downward movement of the deck 12, as described in connection with the various embodiments, may involve a type of yieldable, "dash-pot" or orifice controlled cushioning action, for example, with the motivating force for the final downward movement of the deck 12 resulting from ballasting of the vessel 23, in the circumstances heretobefore described. Obviously, combinations of ballasting and controlled bleeding of vertical cushioning units, or the use of either technique alone may be employed, depending upon the desired circumstances.

For example, as shown in FIG. 25, where especially rapid downward movement or setting of the deck 12 may be desired, the lowering of the deck 12 may be effected under the control of yieldable cushioning ram assemblies 72. Four such ram assemblies may be employed to support the underside of the deck 12 in the manner shown in FIG. 25, with each such lowering assembly itself comprising an array of four, vertically oriented, cushioning rams corresponding generally to the ram structures described in connection with the mechanism 47 of FIG. 27 (but with the outlets 50*c* of such rams providing controlled venting via suitable hydraulic circuitry).

By maintaining appropriate valve control over the out flow of fluid from the cavities 50 of each of the cylinders 48 of the cushioning rams 47, it is contemplated that the integrated deck 12 may be lowered exceedingly rapidly, possibly involving a matter of only several seconds. Such lowering action could entail the maintenance of the same rate of ram movement (under appropriate supplemental pump control) to effect final separation of the upper framing 73 of the ram assembly from supporting means 74 on the underside of the integrated deck 12.

Another technique which may be employed to facilitate and cushion the engagement between the deck 12 and the substructure 1 is schematically illustrated in FIGS. 28 and 29.

At each of the main corners of the deck and substructure, there may be employed an arrangement as shown generally in FIG. 28 involving a downwardly projectable probe 75 carried by the deck 12 and a plastically yieldable socket 76 carried by the substructure 1.

Socket 76 may comprise a socket filled with plastically deformable material such as tar, plastic, elastomeric material, extrudable metal, etc.

As depicted in FIG. 28, the upper portion 77 of socket 76 may be larger than the projectable probe, with a lower portion 78 being smaller and operable to generally telescopingly receive the probe 75.

With the probes 75 projected downwardly, and locked into position, the deck could be lowered so as to bring the probes 75 into engagement with the large socket areas 77. The probes when engaged in the large socket area, would be free to undergo both lateral and vertical movement, as well as tilting movement, so as to provide horizontal and vertical shock absorbing action as well as wave action dampening action. Continued lowering of the deck 12 would move the probes 75 into the more restricted, alignment portions 78 of the socket 76, thereby tending to insure that the probe housing 79 would be free to move downwardly into telescoping, mating engagement with the sockets 77 so as to effect final engagement between the deck 12 and substructure 1.

If desired, the mechanism described in connection with FIG. 28, and contemplated for employment at main structure corners (usually on the outside of the offshore structure), may be supplemented by other, plastically deformable probe and socket arrangements, as depicted generally in FIG. 29.

As shown FIG. 29, sockets 80, carried by substructure 1, and filled with plastically deformable material such as tar or other materials above noted, may be telescopingly engageable by probe-like leg portions 81 formed on the underside of deck 12. Such supplemental cushioning arrangements are intended primarily to provide vertical cushioning or shock absorbing action.

Having now described the shock absorbing, wave action dampening, and alignment aspects of various embodiments of the inventions, attention will now be focused upon those aspects of the invention pertaining to the desired rapid separation of the deck supporting barge from the deck, after the load of the deck has been transferred to the substructure.

Methods And Apparatus For Avoiding Wave Action Damage By Effecting Rapid Separation Of Vessel From Substructure Supported Deck To a substantial extent, the techniques and advantages involving rapid separation of the deck supporting vessel 23 and the deck 12, after the load of the deck 12 has been transferred to the substructure 1, have already been described.

As was noted in connection with FIGS. 20–22, one technique presently contemplated for effecting such rapid separation involves the supporting of the deck 12 on barge or vessel superstructure means, such as the rocker beam means 21, which may be collapsed or moved downwardly relatively rapidly.

As will be appreciated, when the load of the deck 12 is transferred to the substructure 1 through the ballasting of the vessel 23, the initial downward movement of the deck, which brings the deck into engagement with the superstructure, will proceed at a relatively slower rate, compared with the relatively more rapid downward movement of the rocker beams 21.

The relatively rapid separation of the underside of the deck 21 from the top portion of the deck supporting vessel 23 is deemed highly desirable in order to insure that wave action does not induce damage between the vessel 23 and the underside of the deck 12 while these components are being separated.

Having described overall and detailed method and apparatus aspects of the various inventions presented through this disclosure, it is here appropriate to summarize major advantages of the invention and indicate the scope of subject matter deemed to be encompassed by claimed subject matter.

SUMMARY OF MAJOR ADVANTAGES AND OVERALL SCOPE OF INVENTION

The unique utilization of lateral force transmitting arch-like means, in either the form of the deck arch means 17 or the inverted substructure arch means 8, provides significant strengthening of the offshore structure, coupled with desirable reductions in requisite weight and utilization of structural materials.

Significantly, the horizontal force transmitting arch-like structures are not employed so as to impose horizontal loads across the body of the deck transporting barge means thereby minimizing structural strength requirements of the vessel and related vessel weight.

It will also be appreciated that, in the unique double arch arrangement, depicted for example in FIG. 11, arch means 8 and 17 cooperate to define a uniquely strengthening integrated deck and vessel passageway in an offshore structure.

Advantageously, the vessel passageway could be employed, for example, as an access route for service and personnel and equipment handling boats, with the vessels moving into the passageway 5 and effecting personnel and/or equipment transfers upwardly through the body of the deck 12 through desired working locations.

The various arrangements herein presented which afford composite horizontal and vertical shock absorbing action, wave action dampening, and alignment action between the deck and substructure are believed to contribute to particularly effective and well controlled deck setting operations.

By maintaining vertical and horizontal shock absorbing action directly between the deck and substructure, total reliance upon devices such as fender mechanisms between vessels and the substructure are avoided, even though such supplemental structures of this nature may be desirable.

Where the inventions are practiced so as to make it desirable to employ vessel ballasting to set the deck on the substructure, the third independently significant aspect of the invention, entailing rapid separation of the vessel and deck, comes into focus. This aspect of the invention uniquely facilitates removal of the deck supporting vessel from engagement with the deck so that it may be moved out of the vessel passageway, while minimizing the likelihood of structural and potentially damaging inter-engagement between the deck and vessel caused by wave action.

Other advantages attendant upon specific refinements of the invention will have been made apparent from the foregoing discussion and/or be implicit therein.

With respect to the scope of the invention, those skilled in the offshore art and familiar with this disclosure will doubtless envision a wide variety of techniques for practicing the inventive concepts herein disclosed.

In this connection, it will be appreciated that the structure and configuration of all components herein described may be significantly varied, as may be manipulative steps, consistent with the basic format of the invention as hereinbefore set forth.

In addition to the various structures, embodiments, and advantages heretobefore discussed, it may be noted that the assembly 21 is presently preferred in a non-pivotable format, i.e. a support frame format merely capable of rapid, downward "collapsing" movement, as permitted by the removal of mechanical restraining means such as blocks or wedges.

Further, it is now recognized that, during transportation to an installation site, the deck/barge assembly provides unique stability and safety due to the wide barge width contemplated (may be 160 feet), and the high center of gravity and lateral load distribution provided by the transverse supporting of the deck on the barge.

In short, those skilled in the offshore art and familiar with this disclosure will well envision additions, deletions, substitutions, equivalents, and other modifications in relation to specific methods and apparatus herein disclosed which would be deemed to fall within the purview of the invention as set forth in the appended claims and as to which a claim of proprietary subject matter is made.

What is claimed is:

1. A method of forming an offshore structure comprising:

providing substructure means, connected with a submerged surface;

supporting an integrated deck means on vessel means;

moving said vessel means so as to position said integrated deck means over said substructure means;

lowering said integrated deck means at a first, relatively slower transfer rate so as to transfer the load of said integrated deck means from said vessel means to said substructure means; and thereafter separating previously engaged portions of said vessel means and said integrated deck means at a second, relatively more rapid rate, thereby reducing tendencies for wave action-induced forces and movements to cause damage to said integrated deck means and vessel means.

2. Apparatus for forming an offshore structure comprising:

substructure means, connected with a submerged surface;

integrated deck means;

vessel means;

means supporting said integrated deck means on said vessel means;

means operable to move said vessel means so as to position said integrated deck means over said substructure means;

first transfer means for lowering said integrated deck means at a first, relatively slower transfer rate so as to transfer the load of said integrated deck means from said vessel means to said substructure means; and second, separation means for thereafter separating previously engaged portions of said vessel means and said integrated deck means at a second, relatively more rapid rate, thereby reducing tendencies for wave action-induced forces and movements to cause damage to said integrated deck means and vessel means.

3. The apparatus of claim 2 wherein said second, separation means includes:

rocker means, carried by said vessel means and detachably supporting said integrated deck means for yieldably impeded, wave action accommodating movement relative to said vessel means; and support means for said rocker means operable to effect rapid lowering thereof on said vessel means.

* * * * *